US011445885B2

(12) United States Patent
Fletcher et al.

(10) Patent No.: US 11,445,885 B2
(45) **Date of Patent: *Sep. 20, 2022**

(54) DOSING DEVICE AND SYSTEM

(71) Applicant: Reckitt Benckiser Finish B.V., Hoofddorp (NL)

(72) Inventors: Henry Matthew Lawrence Fletcher, Cambridge (GB); Joerg Peter Pflug, Heidelberg (DE); Kai Werner Heppert, Heidelberg (DE)

(73) Assignee: Reckitt Benckiser Finish B.V., Hoofddorp (NL)

( * ) Notice: Subject to any disclaimer, the term of this patent is extended or adjusted under 35 U.S.C. 154(b) by 149 days.

This patent is subject to a terminal disclaimer.

(21) Appl. No.: 16/464,863

(22) PCT Filed: Nov. 28, 2017

(86) PCT No.: PCT/EP2017/080628
§ 371 (c)(1),
(2) Date: May 29, 2019

(87) PCT Pub. No.: WO2018/099899
PCT Pub. Date: Jun. 7, 2018

(65) Prior Publication Data

US 2020/0221924 A1 Jul. 16, 2020

(30) Foreign Application Priority Data

Nov. 30, 2016 (GB) ..... 1620268

(51) Int. Cl.
*A47L 15/44* (2006.01)
*B65D 83/04* (2006.01)
*D06F 39/02* (2006.01)

(52) U.S. Cl.
CPC ..... *A47L 15/4463* (2013.01); *A47L 15/449* (2013.01); *B65D 83/04* (2013.01); *D06F 39/026* (2013.01)

(58) Field of Classification Search
CPC ..... B65D 83/04; B65D 83/0409; B65D 83/0418; B65D 83/08; B65D 83/0805;
(Continued)

(56) References Cited

U.S. PATENT DOCUMENTS 3,178,915 A 4/1965 Hertel
8,651,336 B2 2/2014 Gadini et al.
(Continued)

FOREIGN PATENT DOCUMENTS

CN 1210167 A 3/1999
CN 101836964 A 9/2010
(Continued)

OTHER PUBLICATIONS

Machine Translation of Preugschas, EP1159913A1, Dec. 2001. (Year: 2001).*
(Continued)

*Primary Examiner* — David G Cormier
(74) *Attorney, Agent, or Firm* — Troutman Pepper Hamilton Sanders LLP; Ryan A. Schneider; Chris N. Davis

(57) ABSTRACT

A dosing device or system for dispensing tablets, which can include at least one active ingredient for an automatic washing process, into an automatic washing machine, wherein the dosing device or system is for dispensing one or more, but not all, of the tablets at once into the automatic washing machine, and wherein the dosing device or system can be for dispensing only one tablet at once.

13 Claims, 7 Drawing Sheets

(58) Field of Classification Search
CPC ..... B65D 83/0811; B65D 83/0823; B65D 83/0829; B65D 2583/04; B65D 2583/0431; B65D 2583/0459; B65D 2583/0468; B65D 2583/0472; B65D 2583/0481; B65D 2583/0486; B65D 2583/049; B65D 2583/0495; B65D 2583/08; B65D 2583/082; A47L 15/4463; A47L 15/449; D06F 39/026
See application file for complete search history.

(56) References Cited

U.S. PATENT DOCUMENTS

| | | | | |
|---|---|---|---|---|
| 2002/0117511 | A1 | 8/2002 | McNabb et al. | |
| 2005/0045652 | A1 | 3/2005 | Maser | |
| 2007/0044819 | A1 | 3/2007 | Chan et al. | |
| 2007/0210118 | A1* | 9/2007 | Gadini ..... | D06F 39/026 222/361 |
| 2009/0266389 | A1 | 10/2009 | Classen et al. | |
| 2011/0139820 | A1 | 6/2011 | Kessler et al. | |
| 2011/0189061 | A1 | 8/2011 | Van Loyen et al. | |

FOREIGN PATENT DOCUMENTS

| | | | | | |
|---|---|---|---|---|---|
| CN | 101854843 | A | | 10/2010 | |
| CN | 101877992 | A | | 11/2010 | |
| CN | 102186745 | A | | 9/2011 | |
| CN | 102833996 | A | | 12/2012 | |
| CN | 104264422 | A | | 1/2015 | |
| CN | 104562561 | A | | 4/2015 | |
| CN | 104631056 | A | | 5/2015 | |
| CN | 105019196 | A | | 11/2015 | |
| DE | 19540958 | A1 | | 5/1997 | |
| DE | 19636417 | A1 | | 3/1998 | |
| DE | 10058460 | A1 | | 5/2002 | |
| EP | 0699595 | A1 | | 3/1996 | |
| EP | 1159913 | A1 | | 12/2001 | |
| EP | 1493375 | A1 | | 1/2005 | |
| FR | 2641764 | A1 | | 7/1990 | |
| GB | 2257421 | A | * | 1/1993 | ..... B65D 83/0409 |
| JP | 2000233097 | A | | 8/2000 | |
| JP | 2000233097 | A | * | 8/2000 | |
| JP | 2010136795 | A | | 6/2010 | |
| RU | 2011105425 | A | | 8/2012 | |
| RU | 2560307 | C2 | | 5/2014 | |
| WO | 9701157 | A1 | | 1/1997 | |
| WO | 02058528 | A1 | | 8/2002 | |
| WO | 2004098371 | A2 | | 11/2004 | |
| WO | 2011128672 | A2 | | 10/2011 | |

OTHER PUBLICATIONS

European Search and Examination Report issued in GB1620268.1 dated May 22, 2017.
International Search Report and Written Opinion issued in PCT/EP2017/080628 dated Mar. 16, 2018.
Machine Translation of Preugschas, EP1159913A1, Dec. 2001.
European Search and Examination Report issued in GB1620264.0 dated May 22, 2017.
International Search Report and Written Opinion issued in PCT/EP2017/080625 dated Feb. 26, 2018.
European Examination and Search Report issued in GB1620271.5 dated May 22, 2017.
International Search Report and Written Opinion issued in PCT/EP2017/080630 dated Feb. 19, 2018.
Chinese Office Action dated Jan. 17, 2022.
Chinese Search Report dated Jan. 11, 2022.

* cited by examiner

DOSING DEVICE AND SYSTEM

The present invention relates to a dosing device or system. The invention especially relates to a dosing device or system for reliably dispensing tablets of active ingredient into an automatic washing machine, such as a dishwasher or a laundry washing machine, multiple times over multiple washing cycles.

BACKGROUND RELATING TO THE PRIOR ART

Most commercially available domestic dishwashers have a detergent dispenser which the consumer loads with a single dose of detergent before each wash program. However, a developing area of interest in this field has been the provision of a means to store multiple doses of detergent and deliver them automatically during each successive wash program.

Devices that have been previously disclosed in this area generally fall into the categories of "machine-independent" or "machine-dependent". Machine-independent devices are ones which are not physically connected to the dishwasher's electronics or powered directly by its power source. They can be freely positioned inside the dishwasher, for instance in the rack, so they are not particularly limited by spatial constraints in their design. On the other hand, in order to trigger a dosing step at the appropriate time, they should be designed to respond to sensed parameters of the wash, such as heat, turbidity, etc., which does not always provide a very accurate control mechanism. Conversely, machine-dependent devices are generally connectable to the dishwasher in a predetermined location, and can take their control signals and power from the dishwasher itself. This can lead to more accurate control of when dosing takes place, but brings its own constraints on device design. For instance, a convenient, accessible location to connect such a device is in the door of the dishwasher, but there is limited space in this area, so more attention should be paid to making this type of device as compact and slim as possible. Such machine-dependent devices are the primary focus of the present inventors.

It is known that dosing devices can supply active ingredients to the wash in the form of powders or liquids. However, not all active ingredients can be suitably provided in a liquid composition, whereas powders are liable to suffer from dispensing issues due to moisture intake from the humid washing environment, e.g. swelling or becoming sticky, especially when stored in a container inside an automatic washing machine. It is also known that dosing devices can instead supply tablets to the wash, generally hard tablets formed of compressed powder. The device needs to store multiple tablets and dose one or more individual ones per wash program as required. For effective dosing, it is important to ensure that tablets do not become wedged against each other inside the device. This is a particular challenge for tablets having a flat face, whilst spherical ones can be more difficult to manufacture.

An example of a machine-dependent dosing device is disclosed in EP 1,355,561. In this prior art dosing device, there is provided a rotating disc which can control the delivery of spherical or cylindrical tablets from a container into the main wash tank of a dishwasher. The tablets are pre-sorted and pre-orientated into columns inside the container, with curved surfaces of the tablets touching and guides physically separating the tablets in different columns to restrict their movement. This arrangement is bulky and awkward to manufacture. Also it does not solve the issue of tablets becoming stuck as they are fed into the rotating disc.

A further prior art dosing device for a dishwasher is disclosed in EP 1,159,913. The main portion of this dosing device is located outside the dishwasher, free from space constraints, and a long delivery tube feeds the dosed tablets down inside the machine to the bottom of the main tank. The main body of the device accommodates a loose filling of tablets and has a rotating disc to meter tablets into the dishwasher. However, the tablets are preferably fed to the disc from the bulk via a feed chute accommodating a single column of tablets, which in turn is fed by a conveyor device. In this prior art dosing device, the conveyor device aligns the tablets such that they are all fed into the rotating disc in the same orientation. In this way, jams inside the dosing device are reduced. Again though, the presence of the feed chute and the conveyor makes the dosing device bulky, such that it takes up a lot of space inside the dishwasher.

SUMMARY OF THE INVENTION

According to a first aspect of the present invention, there is provided a dosing device or system for dispensing a plurality of tablets, which each comprise at least one active ingredient for an automatic washing process, into an automatic washing machine, wherein the dosing device or system is for dispensing one or more, but not all, of the plurality of tablets at once into the automatic washing machine, wherein the dosing device or system comprises:

- a container for storing the plurality of tablets, wherein the container comprises an exit port;
- an outlet for delivering the one or more tablets from the container into the automatic washing machine;
- a metering mechanism located between the exit port of the container and the outlet; and
- a housing which surrounds the metering mechanism, wherein the housing comprises an inlet opening for receiving the one or more tablets from the exit port of the container, and an output opening for delivering the one or more tablets to the outlet;
- wherein the metering mechanism is linearly moveable in the housing between a first position in which the one or more tablets is receivable in the inlet opening, and a second position in which the one or more tablets is deliverable to the outlet.

According to a second aspect of the present invention, there is provided a cartridge comprising one or more dosing devices according to the invention in its first aspect, comprising a plurality of tablets inside the or each container, each tablet comprising at least one active ingredient for an automatic washing process.

According to a third aspect of the present invention, there is provided a kit comprising an automatic washing machine and at least one cartridge according to the invention in its second aspect.

According to a fourth aspect of the present invention, there is provided an automatic washing machine comprising a device or system comprising an outlet, metering mechanism and housing each as defined in the first aspect of the invention, wherein the device or system is configured to connect with a container to form a dosing system according to the invention in its first aspect, wherein the container comprises an exit port and a plurality of tablets inside the container, each tablet comprising at least one active ingredient for an automatic washing process.

Embodiments described herein in relation to one aspect of the invention apply equally to other aspects of the invention unless specified to the contrary or the context otherwise requires.

DETAILED DESCRIPTION

Figure 1B:
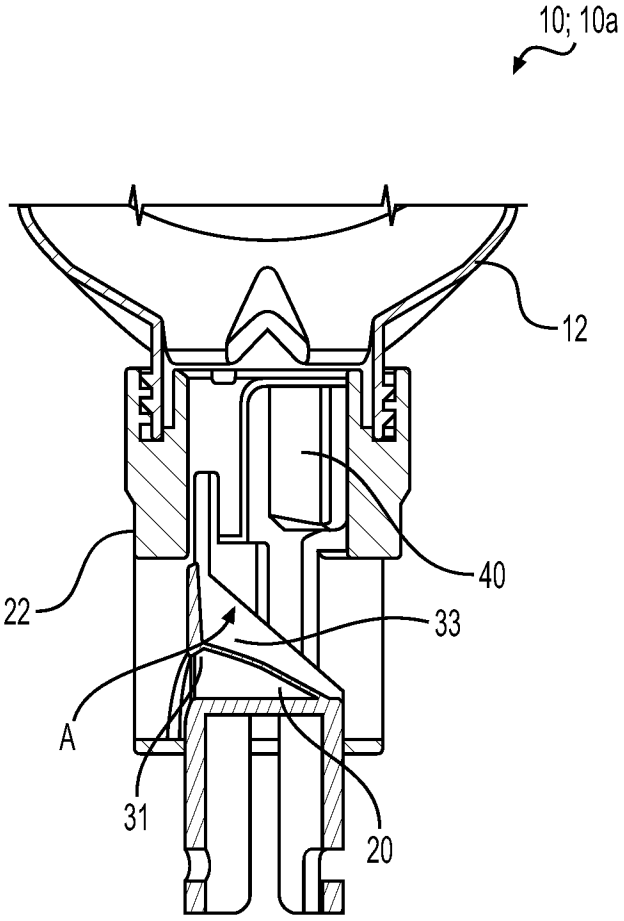
FIG. 1*b* shows a cross-sectional view of this dosing device in a second, open, position.

In the present invention, the metering mechanism is linearly moveable between the first and second positions. It may additionally be rotatable between these positions. This might be achieved, for instance, by having a metering mechanism which moves between the first and second positions by way of a screw thread, or by having a metering mechanism which is threadably engageable with the housing. In an embodiment, the housing is cylindrical. The device or system of the present invention may advantageously be made less bulky than the prior art rotary devices and systems without suffering jamming issues as its size decreases.

Movement of the metering mechanism between its first and second positions may be driven by a motor.

The inlet opening may extend in a direction which is transverse the direction of the output opening. The dosing device or system may further comprise a projection on one of the housing or the metering mechanism, which is operable to engage with a slot in the other of the housing or the metering mechanism, for guiding the movement of the metering mechanism inside the housing.

The metering mechanism preferably defines at least one cavity in which one or more tablets, preferably only one tablet per cavity, is operable to be held during movement of the metering mechanism from the first position to the second position.

The dosing device or system may further comprise a resilient portion on the metering mechanism which is operable to be deflected by a protrusion on the housing as the metering mechanism is moved from the first position to the second position, such to prevent more than the desired number of tablets passing from the container through to the outlet during a movement of the metering mechanism from the first position to the second position.

In use of the dosing device or system, tablets which are located in the container are preferably fed by gravity towards the metering mechanism. In this way, the need for a separate mechanism to feed tablets inside the container towards the metering mechanism is removed. In an embodiment, the metering mechanism is linearly moveable in a vertical direction in use. The metering mechanism may have a sloping surface at an end adjacent the exit port, along which a tablet can slide.

The dosing device or system may further comprise a push member which is operable to push at least one tablet from the metering mechanism to the outlet when the metering mechanism is in the second position. In this case, the push member may be operable to pass through an opening in the metering mechanism.

The dosing device or system may further comprise a biasing means for biasing the metering mechanism from the second position towards the first position. This biasing means helps keep the dosing device or system in a closed position when the device is not carrying out a dispensing step. In this way, the biasing means also helps prevent any moisture which may be present in the air at the outlet (such as moisture deriving from the interior space of the automatic washing machine, or atmospheric moisture during storage) from leaking back into the container, and degrading the tablets located therein.

In an embodiment, the dosing device or system comprises an agitation means which projects from the metering mechanism. In an embodiment, the agitation means is integrally formed with the metering mechanism. Alternatively, the agitation means may be a separately formed component from the metering mechanism. It may engage with or against the metering mechanism. In any case, when the metering mechanism causes the agitation means to move, tablet(s) in the vicinity of the exit port are agitated, which reduces the chance of them becoming wedged against each other or against the sides of the exit port and thereby blocking the exit port.

Preferably, a maximum width of the agitation means is no more than four times, more preferably no more than three times, a maximum diameter of the exit port. In this way, the size of the agitation means can be restricted so as to not occupy a large amount of space inside the container.

In the invention, the container, metering mechanism and housing may all be located in a cartridge for connection to an automatic washing machine. Alternatively, the metering mechanism and housing may already be located in an automatic washing machine, and the container is a separate product to be connected in the appropriate position. The cartridge or container may be connected to the automatic washing machine via a suitable interface.

The cartridge, dosing device or system may be made of any suitable materials. Preferably, at least the container is made of a plastics material and/or is thermally insulated, to prevent heat damage to the tablets inside. Preferably, the container converges towards the metering mechanism. For example, it may be funnel shaped.

Preferably, the dosing device or system is configured to dispense only one tablet at a time.

In an embodiment, the cartridge, dosing device or system has no internal electrical power source, e.g. no battery. In an embodiment, the cartridge, dosing device or system is electrically connected to the automatic washing machine.

The cartridge, dosing device or system need not comprise any temperature, turbidity, conductivity and/or water sensor. It may comprise no sensors at all. It may be controlled based on signals from such sensors found elsewhere in the automatic washing machine. This simplifies its construction and reduces its cost.

The tablets comprise one or more active ingredients for an automatic washing process. As will be appreciated by the skilled person, the nature of the active ingredient(s) used in the tablets will vary depending on the desired application. When used inside a dishwasher, the tablets may, for example, comprise an active ingredient performing a dishwasher detergent, rinse aid, machine cleaner or dishwasher deodorizing function. In the context of laundry washing machines, the tablets may, for example, comprise an active ingredient performing a laundry detergent or fabric softener function. Suitable active ingredients will be known to the skilled person; examples include bleach, bleach activator, bleach catalyst, enzyme, surfactant, builder, pH-adjusting agent, corrosion inhibitor, and fragrance.

Advantageously, each tablet contains a unit dose of the active ingredient, i.e. the entire amount of the active ingredient desired to be used in the washing process, such that only one tablet of that active ingredient needs to be dispensed per washing process (though multiple dosing devices or systems may still be used to dispense multiple tablets of different active ingredients per washing process). In other embodiments, it may be an advantage for the unit dose of the active ingredient to be provided by more than one tablet. For example, in some cases a single tablet containing the entire unit dose may be rather large or heavy, and dosing may be more effective or reliable using multiple smaller or lighter tablets. Preferably, the desired dose of the active ingredient is provided by no more than 10 tablets, preferably no more than 9, 8, 7, 6, 5, or 4 tablets. Preferably, the unit dose is provided by 1, 2, 3 or 4 tablets, in an embodiment 3 or 4 tablets.

Another useful option is to provide tablets each of which contains an amount of active ingredient that corresponds to no more than one unit dose of the active ingredient for at least one washing process of the automatic washing machine. Some automatic washing machines are configured to allow selection between various different modes of operation, such as an intensive wash program and a light wash program, which require different amounts of the active ingredient. Thus, a number of tablets may be dosed during one mode of operation and a different number of tablets are dosed during a different mode of operation. For example, one tablet may be dosed during a wash program for a certain soiling level and two tablets during a wash program designed for a higher level of soiling.

The tablets may be of any suitable form, such as solid, gel tab, or water soluble package/container (preferably of low deformability). Preferably, at least the exterior of the tablets are solid. For example, a capsule of a dissolvable (preferably hard) shell material could enclose a powder, liquid or gel composition. Advantageously, however, the tablets are formed of a compressed powder. Each tablet may, for example, be single phase or multi-layered, and may be otherwise structured to ensure that each active ingredient is released from the tablet at the most optimal time. The tablets may be wrapped in a film of water-soluble material, but preferably they are unwrapped. They may be coated with a suitable coating, e.g. to reduce friability.

The tablets may be of any suitable shape, such as cylindrical, disc-shaped, spherical, spheroidal, or cuboid. In an embodiment, each tablet has at least one flat face. Preferably the tablets are cylindrical or disc-shaped, since spherical tablets are more difficult to manufacture whilst shapes such as cuboid are less easily dispensed. In the case of a cylindrical tablet, preferably the length of the tablet is up to 5% more or less than the diameter of the tablet. When the tablet has edges, preferably at least some of these edges are chamfered and/or filleted to reduce the liability to chip during manufacture and whilst the tablet is in the dosing device. Preferably the chamfer has an angle of 15 to 20 degrees.

In an embodiment, each tablet has a weight of: at least 0.1 g, at least 0.5 g, at least 0.7 g, at least 1 g, at least 1.2 g, at least 1.5 g, at least 2 g, at least 3 g, at least 4 g, or at least 5 g; and/or up to 15 g, up to 14 g, up to 13 g, up to 12 g, up to 11 g, up to 10 g, up to 9 g, up to 8 g, up to 7 g, or up to 6 g. In an embodiment, each tablet has a maximum length and/or diameter of: at least 5 mm, at least 6 mm, at least 7 mm, at least 8 mm, at least 9 mm, or at least 10 mm; and/or up to 20 mm, up to 19 mm, up to 18 mm, up to 17 mm, up to 16 mm, or up to 15 mm.

Preferably, the tablets are loosely filled into the container. Preferably, they are randomly oriented therein. The maximum dimension of each tablet may be, for example, less than ⅔ of, or less than half of, the width of the exit port. Thus, in an embodiment, there is plenty of room for the tablets to be agitated in the vicinity of the exit port.

The cartridge of the second aspect of the invention comprises one or more of the inventive dosing devices, and a plurality of tablets inside the or each container. The third aspect of the invention provides a kit of at least one of these cartridges and an automatic washing machine.

Advantageously, the invention allows the dispensing of different tablets into the automatic washing machine separately. Different tablets may need to be stored separately due to incompatibility, or may be more effective if dispensed at different times during a single wash process, or may be adapted to different types of wash programs. For example, it may be advantageous to dose a bleach-containing tablet separately from an enzyme-containing tablet. It may also be desirable to dose a tablet containing a high level of an active ingredient during an intensive wash program for heavily soiled items, but a tablet containing a lower level of an active ingredient during a lower intensity wash program for more lightly soiled items.

In an embodiment, the cartridge comprises at least two of the inventive dosing devices. Alternatively or in addition, two or more cartridges may be provided in a kit. Preferably, the tablets inside the container of a first dosing device are different from the tablets inside the container of a second dosing device. The tablets may differ in the type of active ingredient(s) included, or in the amount of active ingredient(s), or in another respect. The operation of the first dosing device is preferably independent from the operation of the second dosing device.

Each container may be refillable with tablets, or may be single-use such that when a container runs out of tablets, it is disposed of.

An automatic washing machine may be provided with a dosing device of the invention or a system comprising two or more dosing devices of the invention. Preferably, the dosing devices can be operated independently.

The automatic washing machine may be, for example, a dishwasher or a laundry washing machine. Preferably, it is a dishwasher, preferably a domestic dishwasher. In an embodiment, it is a dishwasher having a single tank. Preferably, the dishwasher does not operate on a conveyor system, i.e. the dishes remain stationary during the wash rather than being moved through one or more tanks. Preferably, the dishwasher has a main wash space which is closed by a door. In an embodiment, the cartridge, dosing device or system is located at least partially inside the main wash space during use, for example it may be partially embedded in a wall and partially projecting into the main wash space during use, or it may be attached to a wall of the main wash space. In an embodiment, the outlet of the dosing device or system delivers the tablets directly into the main wash space.

In an embodiment, the inventive cartridge, dosing device or system connects to the automatic washing machine in a predetermined location of the automatic washing machine. The connection may be via an interface. In the case of a dishwasher, preferably the inventive cartridge, dosing device or system connects to the dishwasher via an interface in a door of the dishwasher. The interface may comprise electrical and/or optical connections to transfer power and/or control signals between the automatic washing machine and the cartridge, dosing device or system.

Preferably, the automatic washing machine has a controller which controls the operation, and dispensing of tablets from, the container(s).

Also disclosed herein is a method of dispensing tablets into an automatic washing machine, using a dosing device or system according to the invention, comprising moving the metering mechanism linearly from the first position to the second position and metering at least one tablet into the automatic washing machine. In an embodiment, at least one tablet is dispensed directly into a main wash space of the automatic washing machine. Preferably, at least one tablet is dispensed during a main wash cycle of a dishwasher. Alternatively or in addition, at least one tablet may be dispensed during a rinse cycle of the dishwasher.

When an agitation means is present, this preferably agitates the tablets concurrently with, and/or just prior to, metering by the metering mechanism. The agitation means does not need to agitate the tablets at other times, which helps to conserve power.

Preferred embodiments of the invention will now be described further with reference to the accompanying Figures.

Figure 1A:
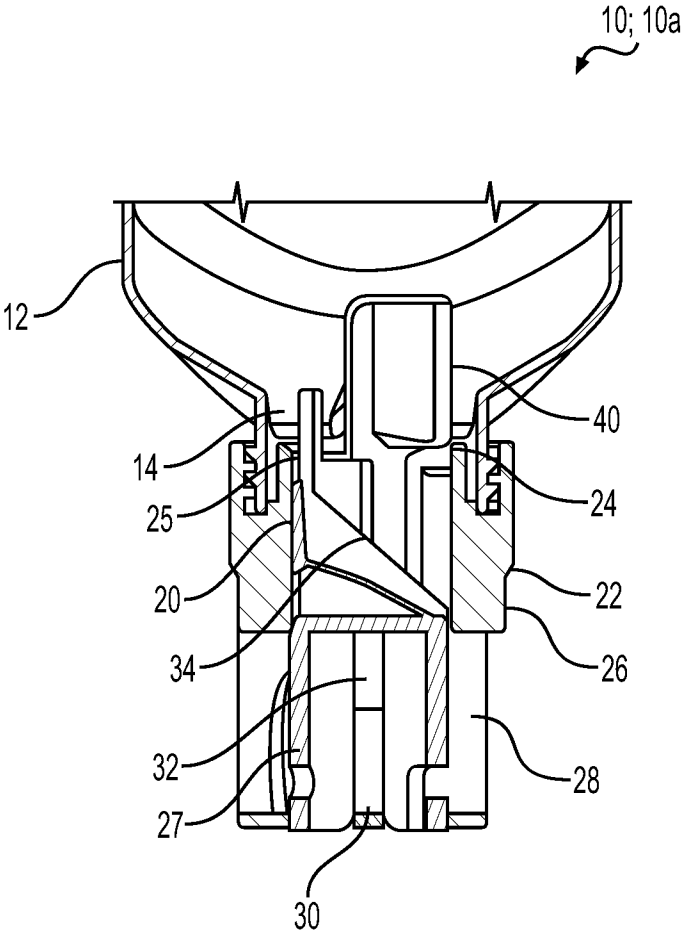
FIG. 1*a* shows a cross-sectional view of a first embodiment of a dosing device according to the invention in a first, closed, position.

With reference to FIGS. 1*a* and 1*b*, there is shown a dosing device 10;10*a* for use in an automatic washing machine. At its top end, the dosing device 10 comprises a container 12 containing a plurality of tablets (not shown). The bottom of the container 12 is funnel shaped and converges towards an exit port 14 of the container 12.

A metering mechanism 20, cylindrical in shape, is connected to the container 12 for receiving a tablet from the exit port 14. The metering mechanism is surrounded by a housing 22 in which the metering mechanism 20 is moveable in a linear direction between a first, closed, position as shown in FIG. 1*a* and a second, open position as shown in FIG. 1*b*.

The housing 22 is cylindrical in shape, and is vertically orientated such that it defines a top surface 24 comprising an inlet opening 25 through which a tablet is fed from the exit port 14 of the container 12. Extending through a side wall 26 of the housing 22 is an output opening 28 through which a tablet is dispensed when the metering mechanism 20 is in its second position. The bottom of the housing 22 comprises a projection 30 which engages with a corresponding slot 32 located towards the bottom of the metering mechanism 20.

The top portion of the metering mechanism 20 is configured to support a tablet originating from the container 12. In this regard, the top portion of the metering mechanism 20 comprises a resilient portion 33 defining a sloping surface 34 which, when the metering mechanism is in the first position, extends from the inlet opening 25 towards a portion of the side wall 26 which is located above the output opening 28 of the housing 22. When the metering mechanism is lowered into its second position, the sloping surface extends towards the output opening 28 of the housing 22. In this way, a tablet located on the sloping surface 34 is operable to slide from the surface and out through the output opening 28.

To prevent more than one tablet passing from the container 12 through to the output opening 28 during a movement of the metering mechanism 20 from the first position to the second position, the housing 22 may be provided with a protrusion 31 located in a portion 27 of the side wall 26 that is opposite the opening 28.

In the first position of the metering mechanism 20, the protrusion 31 is resiliently deflected away from the opening 28 by a portion of the metering mechanism 20, as shown in FIG. 1*a*. When the metering mechanism is lowered into the second position, the protrusion 31 is free to deflect back towards the opening 28 such that it engages, and applies a biasing force against, the sloping surface 34 of the resilient portion 33. As a result of the biasing force, the sloping surface 34 is moved in a direction A as shown in FIG. 1*b* towards the output opening 28, such that the sloping surface 34 sufficiently blocks the output opening 28 to prevent any second tablet which may have fallen into the metering mechanism 20 from exiting through the output opening 28.

To dispense the second tablet, the metering mechanism 20 must be reverted to its first position, and subsequently moved back to its second position.

The output opening 28 from the housing 22 is connected to an outlet 29 (not shown in FIGS. 1*a* and 1*b*) of the dosing device 10, which delivers a tablet fed through the metering mechanism 20 into the dishwasher in which the dosing device is located in use.

Projecting from the top portion of the metering mechanism 20, and through the exit port of the container 12, is an agitation means 40. The agitation means is linearly moveable with the metering mechanism, and is preferably integrally formed therewith such that the agitation means 40 and the metering mechanism 20 form the same component.

The function of the agitation means 40 from the dosing device 10 is to agitate tablets in the vicinity of the exit port 14 as the metering mechanism 20 is moved, such to help dislodge any tablets in the container 12 which would otherwise block the exit port 14.

The agitation means 40 can take any shape which helps with the agitation of tablets located near the exit port 14. For instance, although shown in FIGS. 1*a* and 1*b* as being block-shaped, the agitation means 40 could comprise a helically shaped portion which extends into the container 12.

To prevent damage to any tablets located inside the container 12 as the agitation means 40 moves in use, the agitation means 40 preferably has a degree of flexibility.

Figure 2A:
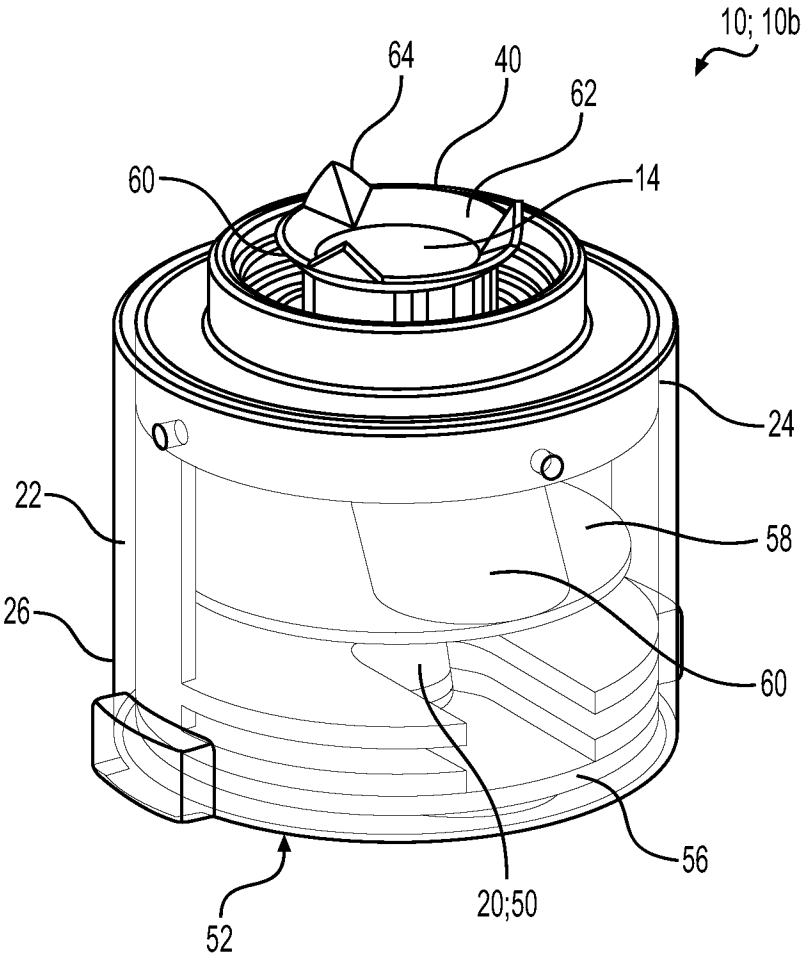
FIG. 2*a* shows a perspective view of a comparative dosing device not according to the invention.
Figure 2C:
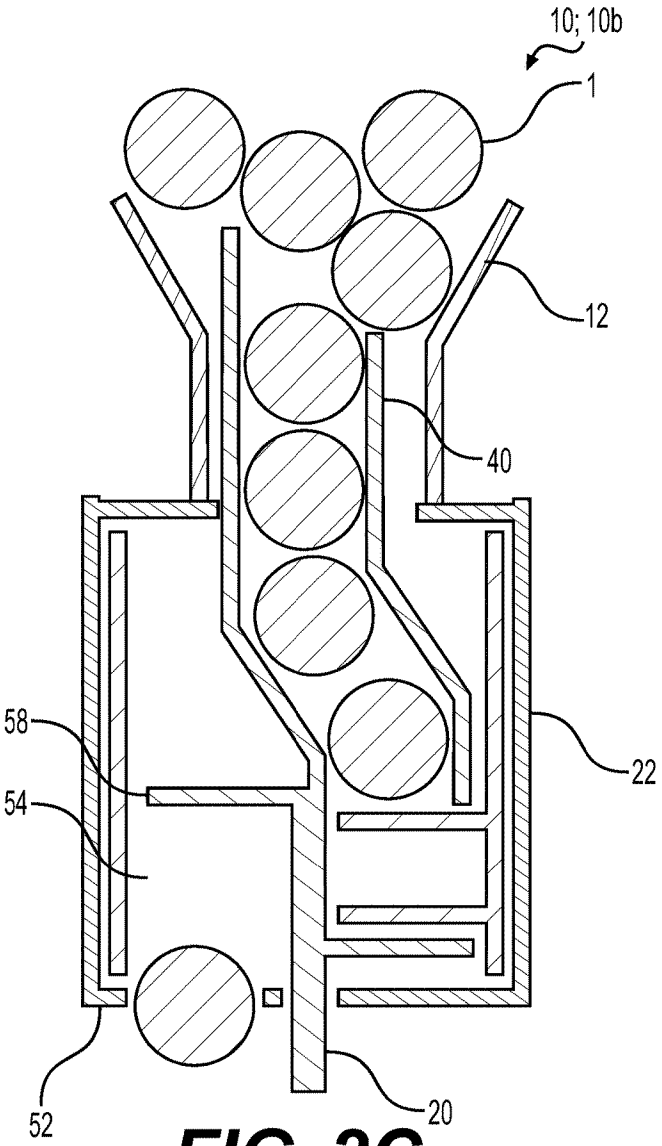
FIG. 2*c* shows a schematic cross-sectional view of this dosing device in a second, open, position.
Figure 2B:
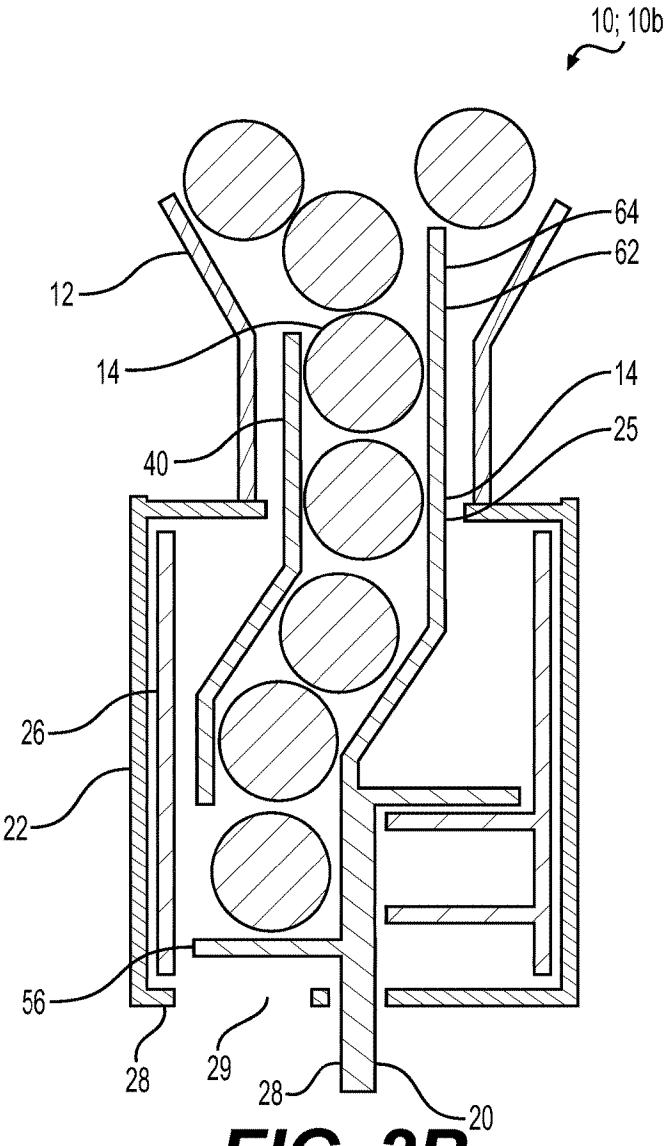
FIG. 2*b* shows a schematic cross-sectional view of this dosing device in a first, closed, position.

With reference to FIGS. 2*a*-2*c*, there is shown a comparative dosing device 10;10*b* for administering tablets into an automatic washing machine.

In common with the dosing device shown in FIGS. 1*a* and 1*b*, this dosing device 10;10*b* comprises a container 12 for tablets 1, a metering mechanism 20, a cylindrical housing 22, an outlet 29, and an agitation means 40. This dosing device 10;10*b* is operable to move between a first position as shown in FIG. 2*b* and a second position as shown in FIG. 2*c*.

The metering mechanism 20 from the comparative dosing device 10*b* is rotatable inside the housing 22 about a spindle 50 which extends completely through the housing 22. The output opening 28 of the housing 22 is located on a bottom surface 52 of the housing 22.

The metering mechanism 20 defines a cavity 54 in which a tablet 1 from the container 12 is operable to be held during rotation of the metering mechanism 20 inside the housing 22 from the first position to the second position. The cavity 54 is located towards the side wall 26 of the housing 22, and is offset from the rotation axis of the spindle 50. The bottom of the cavity 54 is defined by a first plate 56 which is located inside the housing 22 and which radially projects from a lower portion of the spindle 50. The first plate 56 is connected to the spindle 50 such that it separates the cavity 54 from the outlet 29 when the metering mechanism 20 is in the first position, but not in the second position.

The top of the cavity 54 is defined by a second plate 58 which similarly extends from the spindle 50, and which is located inside the housing 22 above the first plate 56. In use, the second plate 58 separates the cavity 54 from the exit port 14 of the container 12 when the metering mechanism 20 is in the second position, but not in the first position.

A tube 60 is connected to the spindle 50 for delivering a tablet 1 from the exit port 14 of the container 12 down into the cavity 54 when the metering mechanism 20 is located in the first position. In this first position, the first plate 56 prevents the tablet 1 from passing from the cavity 54 through to the output opening 28 of the housing 22 and the outlet 29 of the dosing device 10*b*.

Upon subsequent rotation of the spindle 50 to the second position, the top of the cavity 54 is covered by the second plate 58 to prevent a further tablet 1 entering the cavity 54, and the first plate 56 no longer blocks the output opening 28 of the housing 22, such that the tablet 1 can pass through to the outlet 29 of the dosing device 10*b*.

An agitation means 40 from this dosing device 10*b* is defined by a crenelated portion 62 added to the top surface of the tube 60. In this regard, the top surface of the tube 60, which is located around the exit port 14 of the container 12, comprises a plurality of crenelations 64 each defining a geometric shape, such as a triangle, a rectangle, or a semi-circle. Since the tube 60 is connected to the spindle 50, as the spindle 50 rotates during use of the dosing device 10*b*, the crenelations 64 on the top surface of the tube 60 rotate around the exit port 14 from the container 12 to agitate tablets in the vicinity of the exit port 14.

Figure 3B:
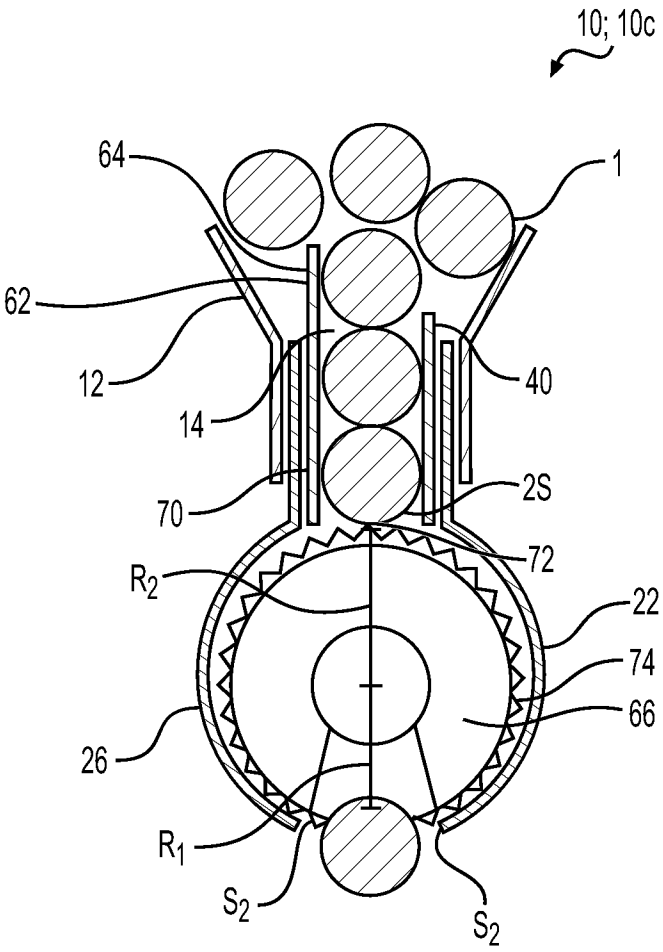
FIG. 3*b* shows a schematic cross-sectional view of this dosing device in a second, open, position.
Figure 3A:
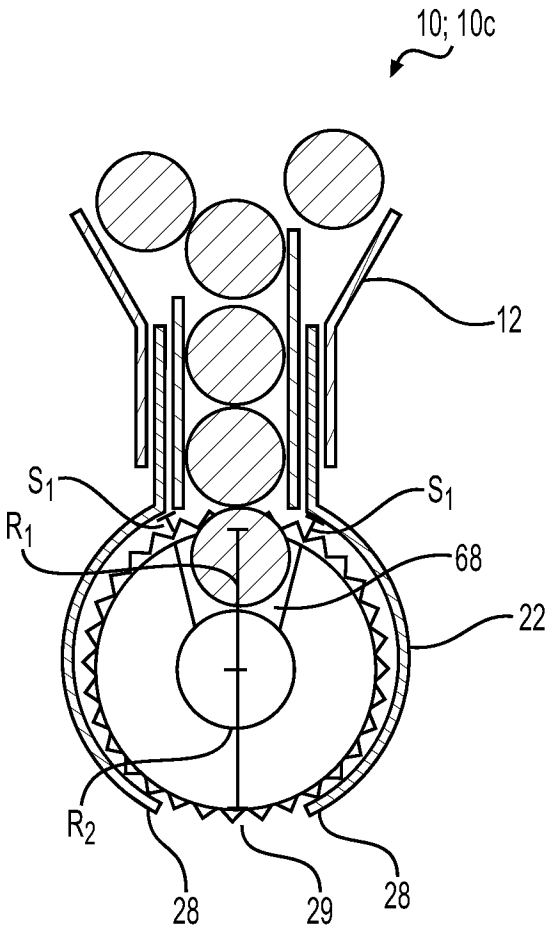
FIG. 3*a* shows a schematic cross-sectional view of another comparative dosing device in a first, closed, position.

With reference to FIGS. 3*a* and 3*b*, there is shown another comparative dosing device 10;10*c* for administering tablets 1 into an automatic washing machine.

In common with the dosing device shown in FIGS. 1*a* and 1*b*, and FIGS. 2*a*-2*c*, this dosing device 10;10*c* comprises a container 12 for tablets 1, a metering mechanism 20, a housing 22, an outlet 29, and an agitation means 40. This dosing device 10;10*c* is operable to move between a first position as shown in FIG. 3*a* and a second position as shown in FIG. 3*b*.

The metering mechanism 20 from this dosing device 10*c* comprises a wheel 66 which is rotatable inside the housing 22. The wheel 66 comprises a recess 68 in which a tablet 1 from the container 12 is operable to be held during rotation of the wheel 66 inside the housing 22 from the first position to the second position. In this dosing device 10*c*, the cylindrical housing 22 is horizontally orientated such that it defines a space in which the wheel 66 is operable to rotate inside the housing 22 about a substantially horizontal axis.

The inlet opening 25 from this dosing device 10*c* is located in an uppermost portion of the horizontal side wall 26 of the housing 22. The output opening 28 is located in a lowermost portion of the horizontal side wall 26, and in a position which is diametrically opposed from the inlet opening 25 inside the housing 22.

In the first position of the metering mechanism 20, the recess 68 from the wheel 66 faces upwards and is in communication with the inlet opening 25 of the housing 22 (as shown in FIG. 3*a*). Upon rotation of the wheel 66 to the second position of the metering mechanism 20, in this second position the recess 68 from the wheel 66 faces downwards and is in communication with the output opening 28 of the housing 22 and the outlet 29 of the dosing device 10*c* (as shown in FIG. 3*b*).

The radius of the wheel 66 is not uniform around its circumference, such that the radius (R1) of the wheel is at a minimum at the angular position of the recess 68, and is at a maximum (R2) at the angular position which is diametrically opposed the recess 68. As a result of this varying radius, the wheel 66 defines an eccentric shape such that as it rotates inside the housing 22, the separation (S1) between the wheel 66 and the inlet opening 25 is maximised when the wheel is in the first position (i.e. when the recess is in communication with the inlet opening 25), and the separation (S2) between the wheel 66 and the output opening 28 is maximised when the wheel is in the second position (i.e. when the recess 68 is in communication with the output opening 28).

By providing a small amount of additional clearance between the recess 68 at the points where it is in communication with either of the inlet opening 25 and the output opening 28, this additional clearance helps guide a tablet 1 into the recess 68, such that the likelihood of a tablet 1 becoming stuck, or getting jammed, inside the metering mechanism 20 during its operation is reduced.

The comparative dosing device 10*c* comprises a tube 70 for delivering a tablet 1 from the exit port 14 of the container 12 down towards the inlet opening 25 of the housing 22.

The agitation means 40 from this dosing device 10*c* is defined by a crenelated portion 62 added to the top surface of the tube 70. The top surface of the tube 70, which is located around the exit port 14 of the container 12, comprises a plurality of crenelations 64 each defining a geometric shape, such as a triangle, a rectangle, or a semi-circle.

The bottom of the tube 70 comprises a series of teeth 72 which engage with corresponding teeth 74 extending around the circumference of the wheel 66.

Since the bottom of the tube 70 comprises teeth 72 which engage with the corresponding teeth 74 on the wheel 66, as the wheel 66 rotates during use of the dosing device 10*c*, the crenelations 64 on the top surface of the tube 70 linearly oscillate up and down, and also rotate around the exit port 14 from the container 12 to agitate tablets in the vicinity of the exit port 14.

Figure 4B:
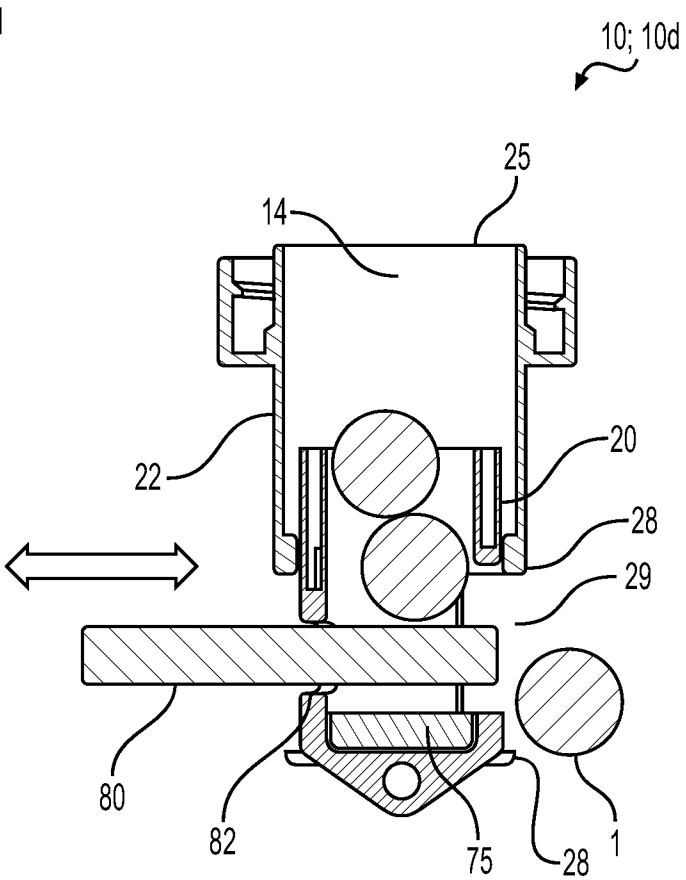
FIG. 4*b* shows a cross-sectional view of this dosing device in a second, open, position.
Figure 4A:
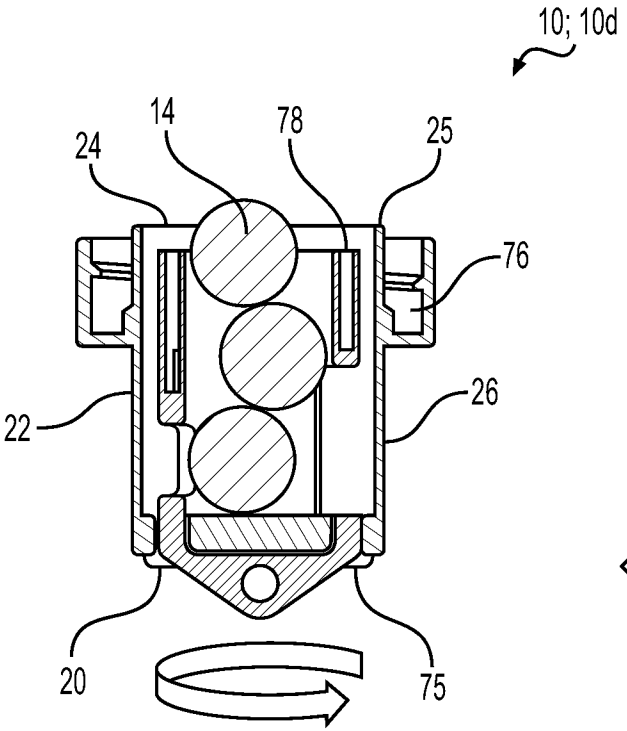
FIG. 4*a* shows a cross-sectional view of a second embodiment of a dosing device according to the invention in a first, closed, position.

With reference to FIGS. 4*a* and 4*b*, there is shown a second inventive dosing device 10;10*d* for administering tablets 1 into an automatic washing machine.

In common with the dosing device shown in FIGS. 1*a* and 1*b*, this dosing device 10;10*d* comprises a container 12 for tablets 1 (not shown in FIGS. 4*a* and 4*b*), a metering mechanism 20, a housing 22 defining an inlet opening 25 at its top and an output opening 28 at its bottom, an outlet 29, and an agitation means 40 (also not shown in FIGS. 4*a* and 4*b*). In use, the metering mechanism is operable to move between a first position as shown in FIG. 4*a* in which a tablet is receivable in the inlet opening 25, and a second position as shown in FIG. 4*b* in which the tablet is deliverable to the outlet 29.

The metering mechanism 20 from this dosing device 10;10*d* is substantially cylindrical and is operable to hold a vertical stack of tablets 1. The bottommost tablet 1 from the stack is operable to sit on a shelf 75 located at the bottom of metering mechanism 20.

The container 12 from this dosing device 10;10*d* is operable to connect with the top portion of the housing 22, preferably by way of a screw thread located around the exit port 14 of the container 12 which engages with a corresponding screw thread 76 located on the top portion of the side wall 26 of the housing 22.

An agitation means 40 in this dosing device 10;10*d* is detachably connected to a slot 78 which extends around the top portion of the metering mechanism 20. In the first position of the dosing device 10;10*d*, and when the container 12 and the agitation means 40 are connected to the dosing device 10;10*d*, the agitation means 40 projects from the metering mechanism 20 and extends through the exit port 14 into the container 12.

To operate this dosing device, the metering mechanism 20 is initially rotated inside the housing 22 such that the agitation means 40 connected to the metering mechanism 20 agitates tablets in the vicinity of the exit port 14. After the tablets have been agitated, the metering mechanism 20 is then lowered from the first position shown in FIG. 4*a* to the second position shown in FIG. 4*b*. In the second position, the dosing device 10;10*d* uses a push member 80 to push a tablet 1 located on the shelf 75 in a lateral direction to the outlet 29. In FIG. 4*b*, the push member 80 is shown as being actuatable through a slot 82 located in a side portion of the metering mechanism 20.

After a tablet 1 from the stack has been pushed out from the metering mechanism 20 via the push member 80, a higher tablet in the stack is able to drop down onto the shelf 75, such that it can be pushed to the outlet 29 via a subsequent actuation of the push member 80.

Figure 5:
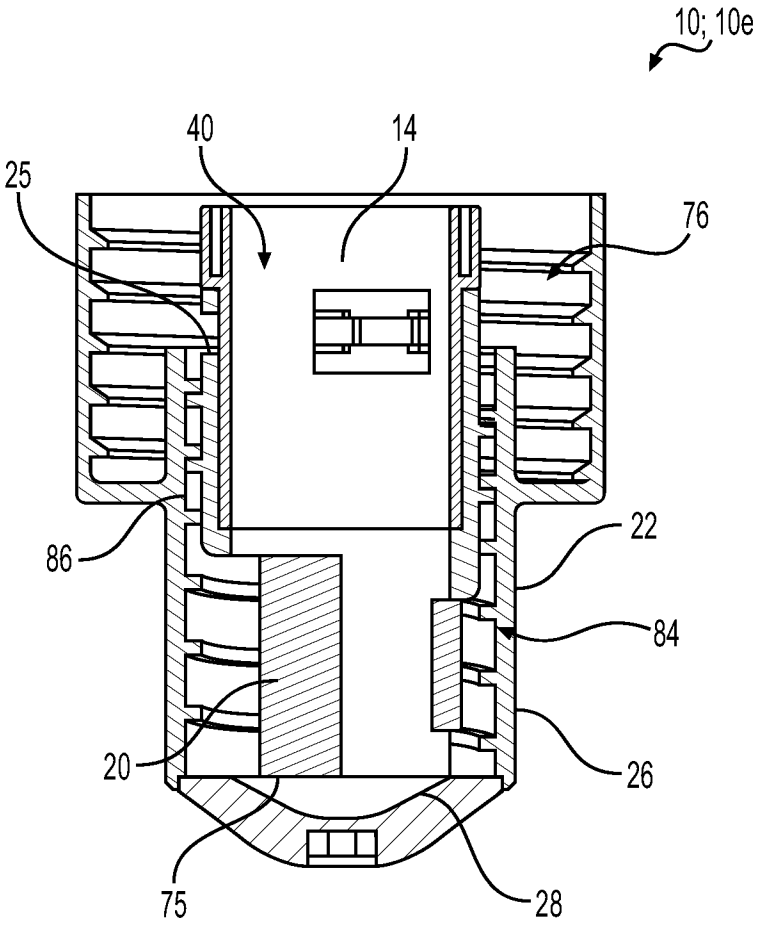
FIG. 5 shows a cross-sectional view of a third embodiment of a dosing device according to the invention.

With reference to FIG. 5, there is shown another inventive dosing device 10;10*e* for administering tablets 1 into an automatic washing machine.

In common with the dosing device shown in FIGS. 4*a* and 4*b*, this dosing device 10;10*e* comprises a container 12 for tablets 1 (not shown in FIG. 5), a metering mechanism 20, a housing 22 defining an inlet opening 25 at its top and an output opening 28 at its bottom, an outlet 29, an agitation means 40, and a screw thread 76 located on the top portion of the housing 22 for connecting the housing 22 to the container 12. This dosing device 10;10*e* is operable to move between a first position in which a tablet is receivable from the exit port of the container, and a second position in which the tablet is deliverable to the outlet 29.

The metering mechanism 20 from this dosing device 10;10*e* is substantially cylindrical and is operable to hold a vertical stack of tablets 1. The bottommost tablet 1 from the stack is operable to sit on a shelf 75 located at the bottom of metering mechanism 20.

In this dosing device 10;10*e*, the metering mechanism 20 comprises an outer surface which defines a screw thread 84 which is operable to engage with a corresponding screw thread 86 located on the inner surface of the side wall 26 from the housing 22.

An agitation means 40 in this dosing device 10;10*e* is detachably connected to a slot 78 which extends around the top portion of the metering mechanism 20. In the first position of the dosing device 10;10*e*, and when the container 12 and the agitation means 40 are connected to the dosing device 10;10*e*, the agitation means 40 projects from the metering mechanism 20 and extends through the exit port 14 into the container 12.

To move the metering mechanism 20 between the first and second positions, the metering mechanism 20 is rotated inside of the housing 22, such that the engaging screw threads 84;86 lower the metering mechanism 20 inside the housing 22.

Mien the metering mechanism 20 is lowered to the second position, a tablet 1 resting on the shelf 75 is able to pass out from the metering mechanism 20 to the outlet 29. In this regard, the shelf 75 may be downwardly sloped towards the outlet 29 such that the tablet 1 proceeds to the outlet 29 via gravity. Alternatively, a push member 80 may be provided as in the dosing device 10;10*d* to push the tablet 1 off the shelf 75.

Each of the dosing devices 10;10*b*;10*c*;10*d*;10*e* described above are operable to dispense at least one tablet into a dishwasher during a wash cycle of the automatic washing machine. Preferably, for each movement of the metering mechanism 20 of each dosing device 10 from the first position to the second position, the dosing device 10 is configured to dispense a single tablet from the container 12 to the outlet 29 of the dosing device.

Movement of the metering mechanism 20 between its first and second positions is controlled using a motor (not shown in the Figures) which is connected to the metering mechanism 20. Operation of the motor is governed by commands sent from a controller located in the automatic washing machine. For a given wash cycle, the controller is configured to instruct the motor to move the metering mechanism 20 between its first and second positions, such that one or more tablets are dispensed by the dosing device 10 into the machine at different times during the wash cycle.

Figure 6:
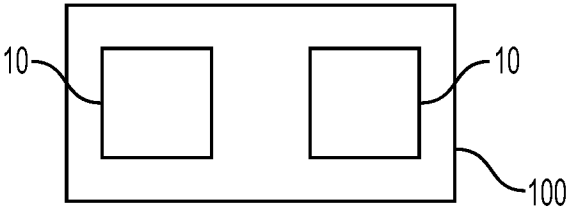
FIG. 6 shows a schematic view of a dosing system according to an embodiment of the invention.

It will be appreciated that by having a plurality of dosing devices 10 arranged in parallel, a dosing system 100 can be provided as shown in FIG. 6. With such a dosing system 100, the dosing devices 10 can be filled with tablets 1 of different active ingredients. In this way, and by having each dosing device 10 individually controlled by the controller, the dosing system can dispense different tablets at different times.

Figure 7:
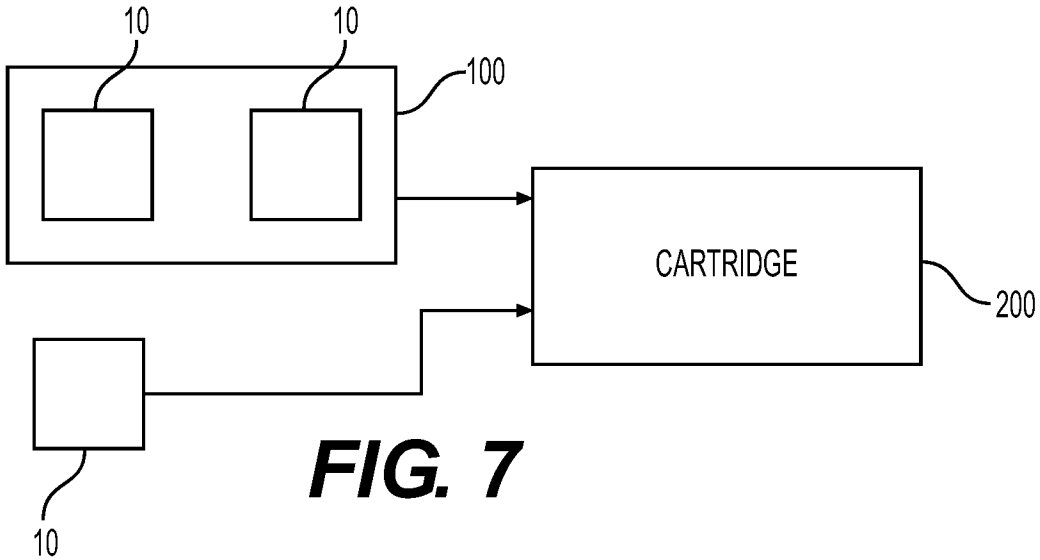
FIG. 7 shows a schematic view of a cartridge according to an embodiment of the invention.

It will also be appreciated that any number of dosing devices 10 and/or dosing systems 100 can be supplied as a cartridge 200, as shown in FIG. 7. The cartridge 200 may either be refillable such that each container 12 therein may be refilled with tablets 1, or the cartridge 200 may be single-use such that when a container 12 runs out of tablets 1, the cartridge 200 is disposed of.

Figure 8:
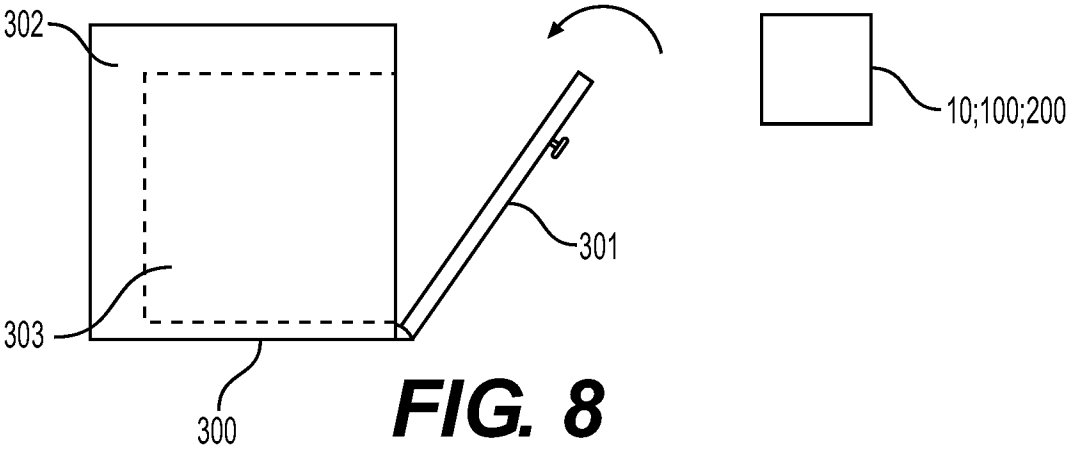
FIG. 8 shows a schematic view of a dishwasher according to an embodiment of the invention.

The dosing device 10, dosing system 100, and cartridge 200 described herein are preferably intended to be connected to, and communicate with a controller located in, a dishwasher 300 as shown in FIG. 8. Possible connection points for the dosing device 10; dosing system 100; or cartridge 200 inside the dishwasher 300 include the door 301, the main housing 302, or the interior wash space 303 of the dishwasher 300, though the door 301 is most preferred for easy accessibility.

Although the dosing device, dosing system, and cartridge of the invention have been described above as being useable with a dishwasher, it is appreciated that they may also be used to administer tablets into other automatic washing machines, such as a laundry washing machine. In this case, the dosing device 10 (or dosing system 100/cartridge 200) would connect to, and communicate with a controller, and a motor, located in the laundry washing machine. When the dosing device 10 is connected with a laundry washing machine, a tablet may advantageously be operable to pass from the outlet 29 of the dosing device 10 into a water tank of the laundry washing machine, such that the tablet can be dissolved into a solution of the active ingredient, which may be then fed, by a pump, into the drum of the machine.

In this way, during operation of the dosing device 10 in a given wash cycle in the laundry washing machine, the controller would be configured to instruct the motor to move the metering mechanism 20 of the dosing device 10 between its first and second positions, such that one or more tablets can be dispensed into the laundry washing machine at different times during the wash cycle.

It will also be appreciated that rather than have all of the components from the dosing device 10 located in a cartridge 200 or all in an automatic washing machine, the components from the dosing device 10 may be distributed between the cartridge and the automatic washing machine. For example, in one configuration the cartridge 200 may be arranged to house the container 12 together with its tablets 1, and the automatic washing machine arranged to support the metering mechanism 20, the housing 22, and the outlet 29. When the cartridge 200 is inserted into the automatic washing machine, the components from the dosing device 10 would then connect up to form the dosing device 10 as described and shown herein.

The invention claimed is:

1. A dosing device comprising:

a container for storing tablets and comprising an exit port;

an outlet configured to deliver tablets from the container into an automatic washing machine;

a metering mechanism located between the exit port of the container and the outlet; and a housing which surrounds the metering mechanism, wherein the housing comprises an inlet opening for receiving one or more tablets from the exit port of the container, and an output opening for delivering one or more tablets to the outlet;

wherein the metering mechanism is threadably engageable with the housing, wherein the metering mechanism is linearly moveable or rotatable in the housing between a first position in which one or more tablets is receivable in the inlet opening, and a second position in which one or more tablets is deliverable to the outlet; and wherein the metering mechanism is in a form selected from the group consisting of:

a cylindrical tube; a cylindrical tube comprising a cavity; a wheel comprising a recess; and a substantially cylindrical portion, and wherein the container converges towards the metering mechanism.

2. The dosing device according to claim 1, wherein the inlet opening extends in a direction which is transverse a direction of the output opening.

3. The dosing device according to claim 1 further comprising a projection on one of the housing or the metering mechanism, which is operable to engage with a slot in the other of the housing or the metering mechanism, for guiding the movement of the metering mechanism inside the housing.

4. The dosing device according to claim 1, wherein the dosing device is further configured to dispense one tablet at a time.

5. The dosing device according to claim 1 further comprising a push member which is operable:

to pass through an opening in the metering mechanism; and to push one or more tablets from the metering mechanism to the outlet when the metering mechanism is in the second position, wherein the push member is in the form of a bar.

6. A cartridge comprising one or more:

the dosing device according to claim 1; and tablets inside the or each container;

wherein each tablet comprises at least one active ingredient for an automatic washing process.

7. A kit comprising:

an automatic washing machine; and the cartridge according to claim 6.

8. The cartridge according to claim 6, wherein one or more of the tablets have a cylindrical shape.

9. The cartridge according to claim 6, wherein one or more of the tablets have a disc shape or discoid shape.

10. A dosing device comprising:

a container for storing tablets and comprising an exit port;

an outlet configured to deliver tablets from the container into an automatic washing machine;

a metering mechanism located between the exit port of the container and the outlet;

a housing which surrounds the metering mechanism, wherein the housing comprises an inlet opening for receiving one or more tablets from the exit port of the container, and an output opening for delivering one or more tablets to the outlet; and a push member which is operable to push one or more tablets from the metering mechanism to the outlet when the metering mechanism is in a second position, wherein the push member is in the form of a bar, wherein the metering mechanism is linearly moveable or rotatable in the housing between a first position in which one or more tablets is receivable in the inlet opening, and a second position in which one or more tablets is deliverable to the outlet; and wherein the metering mechanism is in a form selected from the group consisting of:

a cylindrical tube; a cylindrical tube comprising a cavity; a wheel comprising a recess; and a substantially cylindrical portion, and wherein the container converges towards the metering mechanism.

11. The dosing device according to claim 10, wherein when the metering mechanism is in the form of the cylindrical tube; the cylindrical tube comprising a cavity; or the substantially cylindrical portion, the metering mechanism further comprises-a resilient portion on the metering mechanism which is operable to be deflected by a protrusion on the housing as the metering mechanism is moved from the first position to the second position, so as to prevent more than the one or more tablets passing from the container through to the outlet during a movement of the metering mechanism from the first position to the second position.

12. The dosing device according to claim 10 further comprising an agitation portion projecting from the metering mechanism to agitate one or more tablets in the vicinity of the exit port, the agitation portion comprising a flexible portion and one or both a helically shaped and crenelated portion which extends into the container.

13. An automatic dishwashing machine configured to connect with a container comprising an exit port and tablets comprising at least one active ingredient for an automatic dishwashing process inside the container, the container further comprising:

an outlet configured to deliver tablets from the container into the automatic dishwashing machine;

a metering mechanism located between the exit port of the container and the outlet; and a housing which surrounds the metering mechanism, wherein the housing comprises an inlet opening for receiving one or more tablets from the exit port of the container, and an output opening for delivering one or more tablets to the outlet, wherein the metering mechanism is threadably engageable with the housing, wherein the metering mechanism is linearly moveable or rotatable in the housing between a first position in which one or more tablets is receivable in the inlet opening, and a second position in which one or more tablets is deliverable to the outlet, wherein the metering mechanism is in a form selected from the group consisting of:

a cylindrical tube; a cylindrical tube comprising a cavity; a wheel comprising a recess; and a substantially cylindrical tube, and wherein the container converges towards the metering mechanism.

* * * * *